US010627065B2

(12) United States Patent
Godderidge et al.

(10) Patent No.: US 10,627,065 B2
(45) Date of Patent: Apr. 21, 2020

(54) MOTOR VEHICLE HEADLIGHT

(71) Applicant: ZKW GROUP GMBH, Wieselburg (AT)

(72) Inventors: Sebastian Godderidge, Schollach (AT); Markus Danner, Ollersdorf (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/319,510

(22) PCT Filed: Jun. 29, 2017

(86) PCT No.: PCT/AT2017/060162
§ 371 (c)(1),
(2) Date: Jan. 22, 2019

(87) PCT Pub. No.: WO2018/023141
PCT Pub. Date: Feb. 8, 2018

(65) Prior Publication Data

US 2020/0003382 A1 Jan. 2, 2020

(30) Foreign Application Priority Data

Aug. 4, 2016 (AT) ..... A 50712/2016

(51) Int. Cl.
*F21S 41/24* (2018.01)
*F21S 41/26* (2018.01)
(Continued)

(52) U.S. Cl.
CPC ..... *F21S 41/24* (2018.01); *F21S 41/143* (2018.01); *F21S 41/26* (2018.01); *F21V 5/048* (2013.01);
(Continued)

(58) Field of Classification Search
None
See application file for complete search history.

(56) References Cited

U.S. PATENT DOCUMENTS 5,899,559 A * 5/1999 Lachmayer ..... B60Q 1/1415 362/513
6,736,533 B2 5/2004 Matsumoto et al.
(Continued)

FOREIGN PATENT DOCUMENTS

JP 2006-318922 11/2006
JP 2012216408 A 11/2012
(Continued)

OTHER PUBLICATIONS

Search Report for Austrian Application No. A 50712/2016 dated May 10, 2017.
(Continued)

*Primary Examiner* — Ashok Patel
(74) *Attorney, Agent, or Firm* — Eversheds Sutherland (US) LLP

(57) ABSTRACT

A motor vehicle lighting device (1) comprising at least one light source (2), an optical device (3) which is associated with the at least one light source (2) and into which light of the at least one light source (2) is irradiated, and an optical imaging system (6) associated with the optical device (3), this optical imaging system imaging light exiting from the optical device (3) in front of the motor vehicle lighting device (1), the optical device (3) being set up to concentrate the light of the at least one light source and to direct it in the form of at least two spatially separated light beams to the optical imaging system (6), and in that the optical imaging system (6) is set up to project the light beams in front of the motor vehicle lighting device (1) in the form of two light distributions, namely in the form of a main light distribution and a sign light partial light distribution, the optical device (3) having at least one shield (5) downstream of it that is arranged perpendicular to an optical axis (4) of the optical imaging system (6), the shield (5) having at least one first opening (9) and at least one second opening (10), the at least
(Continued)

one first opening (9) being set up to form a first light beam forming the main light distribution, and the at least one second opening (10) being set up to form a second light beam forming the sign light partial light distribution.

19 Claims, 5 Drawing Sheets

(51) Int. Cl.

| | |
|---|---|
| ***F21S 41/143*** | (2018.01) |
| ***F21V 5/04*** | (2006.01) |
| ***F21Y 115/10*** | (2016.01) |
| ***F21W 102/18*** | (2018.01) |

(52) U.S. Cl.
CPC ..... *F21V 2200/00* (2015.01); *F21W 2102/18* (2018.01); *F21Y 2115/10* (2016.08)

(56) References Cited

U.S. PATENT DOCUMENTS

| | | | | |
|---|---|---|---|---|
| 8,801,242 | B2 | 8/2014 | Hamm et al. | |
| 2005/0152151 | A1 | 7/2005 | Lisowski et al. | |
| 2010/0226144 | A1* | 9/2010 | Stade | F21S 41/143 362/520 |
| 2014/0063833 | A1* | 3/2014 | Park | F21S 41/143 362/520 |
| 2016/0040848 | A1 | 2/2016 | Tsukamoto | |
| 2018/0058652 | A1* | 3/2018 | Taudt | F21S 41/25 |

FOREIGN PATENT DOCUMENTS

| | | | |
|---|---|---|---|
| JP | 2014102941 | A | 6/2014 |
| KR | 20120010491 | A | 2/2012 |
| KR | 10-1340304 | | 12/2013 |
| KR | 10-2015-0072085 | | 6/2015 |

OTHER PUBLICATIONS

International Search Report for PCT/AT2017/060162 dated Sep. 15, 2017.

Korean Patent Office Action of Application No. 10-2019-7005002 dated Jan. 30, 2020.

* cited by examiner

MOTOR VEHICLE HEADLIGHT

The invention relates to a motor vehicle lighting device that comprises at least one light source, which in the turned-on state emits light, an optical device which is associated with the at least one light source and into which light of the at least one light source is irradiated, and an optical imaging system associated with the optical device, this optical imaging system imaging light exiting from the optical device in front of the motor vehicle lighting device in the form of two light distributions, namely in the form of a main light distribution and a sign light partial light distribution. If the motor vehicle lighting device is installed in a motor vehicle and is put into operation, the motor vehicle lighting device produces these light distributions at a distance in front of the motor vehicle.

Moreover, the invention relates to a motor vehicle with at least one such a motor vehicle lighting device.

In the context of this invention, the term "sign light partial light distribution" is understood to mean a partial light distribution that serves to illuminate road signs fastened high over a road. The sign light partial light distribution is sometimes also called an overhead sign partial light distribution. For example, according to ECE regulations a sign light partial light distribution can correspond to a partial light distribution that lies in the top half of zone A (according to ECE R98) and/or zone III (according to ECE R112) and/or in zone III (according to ECE R123), depending on the controller of the motor vehicle lighting device and the type of the light sources that are used.

Motor vehicle lighting devices to produce a sign light partial light distribution—in short sign light—are known in the prior art. AT 514 784 A1 and AT 514 785 A1 of the applicant describe an optical structure that is intended for a motor vehicle headlight lighting device and that can, for example, be put on a lens surface to produce a sign light. The disadvantage of this solution is that the optical structure strongly affect the properties of the lens and moreover is not preferred from the design perspective.

The application EP 2 799 761 A2 discloses a light module for a motor vehicle headlight, this light module having primary optics that convert light coming from a light source into an intermediate light distribution, a horizontally arranged shield being set up so that that light of the intermediate light distribution that passes the shield on a first side of the shield in a first beam path goes into an area lying on a first side of the light/dark boundary in the second light distribution. The light module is characterized in that the primary optics are set up to redirect a part of the light coming from the light source in such a way that it passes the shield on a second side of the shield, and the secondary optics distribute it, in a second beam path, into an area lying in the second light distribution on a second side of the light/dark boundary. A disadvantage of this is that the shield is horizontally oriented. Therefore, the light module is unfavorable, for example, from the perspective of space utilization technique.

The goal of this invention is to eliminate the above-mentioned disadvantages of the prior art and to create a motor vehicle lighting device that takes the demands of modern design into account, does without cost- and time-intensive optical structures, and is space-saving. This is accomplished according to the invention with a motor vehicle lighting device of the type mentioned at the beginning that is characterized in that the optical device is set up to concentrate the light of the at least one light source and to direct it in the form of at least two spatially separated light beams—a first light beam and a second light beam—to the optical imaging system, and in that the optical imaging system is set up to project each light beam in front of the motor vehicle lighting device in the form of a light distribution (the first light beam being in the form of a main light distribution and the second light beam being in the form of a sign light partial light distribution), the optical device having at least one shield downstream of it that is arranged perpendicular to an optical axis of the optical imaging system, the shield having at least one first opening and at least one second opening, the at least one first opening being set up to form the first light beam forming the main light distribution, and the at least one second opening being set up to form the second light beam forming the sign light partial light distribution.

As is known from the prior art, the term "light beam" should be understood to mean a spatially delimited area in which light propagates. A light beam is delimited by marginal rays. Therefore, in the context of this invention, the term "two spatially separated light beams" is understood to mean two non-overlapping light beams that are spaced apart and whose marginal rays do not intersect.

For spatial separation of the light beams, it can be advantageous if the first opening of the shield has a lower edge, this lower edge forming a light/dark boundary in the light pattern, and if the second opening is arranged beneath a middle area of the first opening.

For correct positioning of the sign light partial light distribution in the light pattern, it can be useful if the second opening is arranged beneath the first opening and is symmetrically arranged with respect to a vertical line. In the context of this invention, the term "vertical line" is understood to mean an axis of a coordinate system associated with the motor vehicle lighting device, this axis being vertically oriented if the motor vehicle lighting device is in a position corresponding to the state in which it is installed in a motor vehicle. This coordinate system is selected so that it corresponds to that coordinate system in the image space that is used for measurements on the emitted light distributions. For example, the vertical line in the coordinate system associated with the motor vehicle lighting device corresponds to the vertical line on a plotting screen that is set up in a illuminating engineering laboratory to measure light distributions produced by means of the motor vehicle lighting device.

With respect to the quality of the light distribution produced, it can be advantageous if the shield is arranged in a focal plane of the optical imaging system. The term "focal plane" should not be interpreted in a restrictive sense. For example, the optical imaging system can have a projection surface/projection plane, all objects located in the projection surface being sharply imaged in an image space associated with the optical imaging system.

It can be useful if the optical device has a continuous, preferably planar, light exit surface on which the shield is arranged, preferably without a gap. The advantage of this combination is that a light image simultaneously formed by the light exit surface and the shield or an emitting surface simultaneously formed by the light exit surface and the shield can be arranged in the projection surface of the optical imaging system.

An embodiment that has proven itself in practice can provide that the motor vehicle lighting device comprise multiple light sources, preferably multiple LEDs, and the optical device have multiple light-conducting optical bodies, each light-conducting optical body being associated with exactly one LED, each light-conducting optical body being designed and/or arranged with respect to the associated LED so that only the light of the associated LED is coupled into the optical body. An advantage of this is, for example, that by means of the LEDs and the light-conducting optical bodies it is possible to achieve a collimated homogeneous light or a homogeneous light distribution with the desired discharge. Here the term "light-conducting optical body" is understood to mean an optical body in which light beams coupled into the optical body propagate due to total reflection and only leave this optical body when they encounter an interference point, such as, for example, a redirecting prism or an impurity of the material, or an end of the optical body comprising an exit surface.

To keep the size of the motor vehicle lighting device small and increase the size of the emitting surface, it can be expedient if all light sources, preferably all LEDs, lie in a surface, preferably a plane, arranged perpendicular to the optical axis, and all optical bodies taper (starting from the light exit surface of the optical device) in the direction toward the light sources.

Moreover, it can be advantageous if at least one part of the light-conducting optical bodies, preferably all light-conducting optical bodies, have a common light exit plate.

An especially robust construction of the optical device can provide that the light exit plate is made in a single piece with the light-conducting optical bodies, preferably with all light-conducting optical bodies, belonging to the part.

Furthermore, it can be advantageous if the light sources are arranged in a horizontal row perpendicular to the optical axis of the motor vehicle lighting device, and at least one optical body lying in the center of the row has a lower area projecting downward (with respect to the other optical bodies), preferably with a convex shape, this lower area extending from a light entrance surface of the optical body lying in the center of the row of optical bodies to the light exit surface. It is advantageous that a branch of the light of a single LED can be sufficient to produce the sign light partial light distribution.

In order to produce an especially homogeneous sign light that is pleasant for drivers, it can be expedient if the lower area has a lower, preferably parabolic limiting side.

In order to make the sign light partial light distribution wider, it can be advantageous if at least the optical body lying in the center of the row is set up to form the second light beam.

Moreover, it can advantageously be provided that exclusively the optical body lying in the center of the row is set up to form the second light beam. The other light sources, preferably LEDs, that are not used for the sign light partial light distribution can be dimmed as desired.

For use of the motor vehicle lighting device in city driving, it can be useful if the main light distribution is in the form of a foreground light distribution with a straight horizontal light/dark boundary or in the form of a low beam pattern with a light/dark boundary having a rise.

To make it easier to meet the legally prescribed standards, it can be provided that the optical imaging system be in the form of a lens that collimates the light beam in the vertical direction and widens it in the horizontal direction.

The invention is explained in detail below using sample embodiments that are not restrictive and that are illustrated in a drawing. The figures are as follows.

Figure 1:
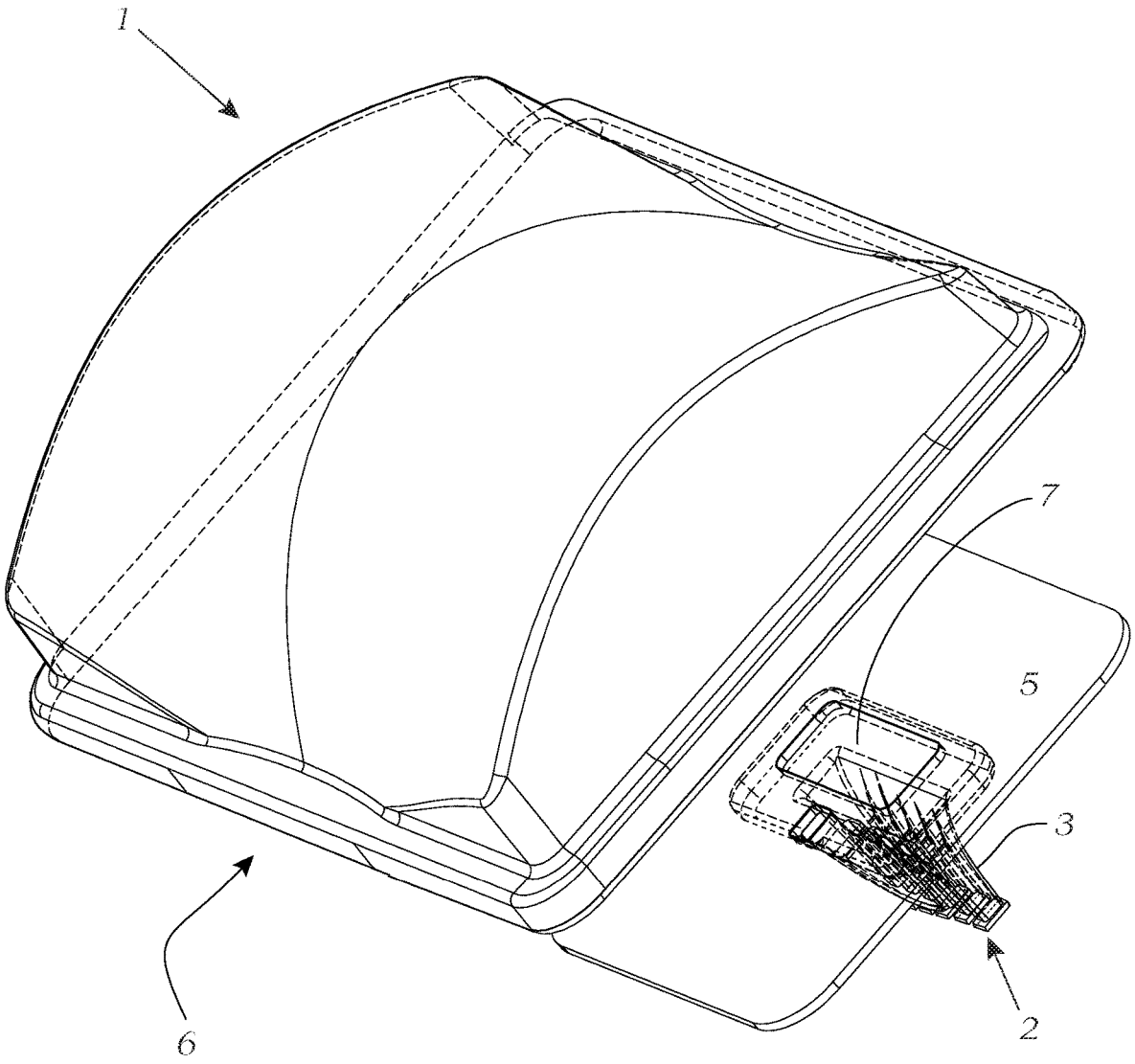
FIG. 1 is a light module of a motor vehicle headlight.
Figure 2:
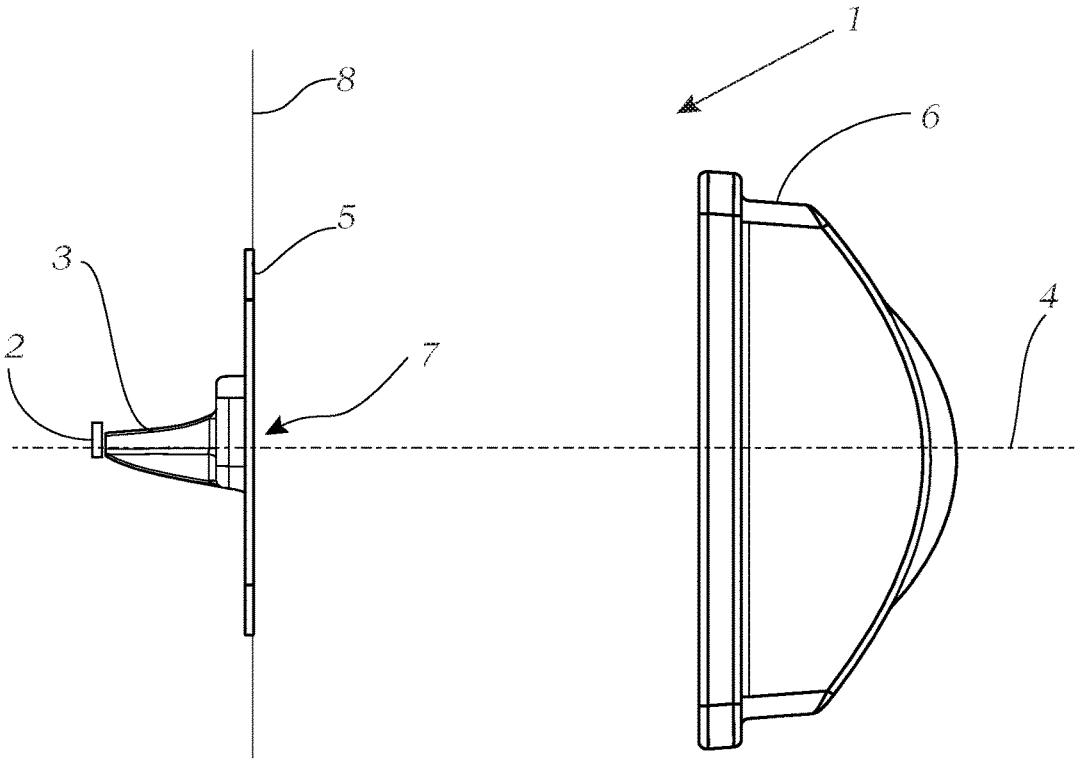
FIG. 2 is a side view of the light module of FIG. 1.

First, please refer to FIGS. 1 and 2. These figures schematically show a motor vehicle headlight light module 1, which can correspond to an inventive motor vehicle lighting device. FIG. 1 shows the light module 1 in a perspective view. The light module comprises a light source 2, which is formed from multiple LEDs that are arranged, for example, in a row, auxiliary optics 3 in front of the light source, the light of the light source being coupled into the auxiliary optics 3 on one side and coupled out on the other side, a shield 5 arranged perpendicular to an optical axis 4 of the light module 1, and a lens 6, which can correspond to an inventive optical imaging system. The auxiliary optics 3 can correspond to the inventive optical device and can be made, for example, of silicone. Simultaneously, it can be expedient if the auxiliary optics 3 have light-conducting properties, i.e., if the light of the LEDs coupled in on one side can propagate in these auxiliary optics 3 without substantial losses, until it exits on the other side, i.e., on a light exit side 7 of the auxiliary optics 3. In order to shape a light distribution that is emitted from the light module 1 that has been put into operation, a shield 5 is provided that either at least partly blocks or lets through the light coming out of the light exit surface 7, depending on the shape and mode of operation of this shield. It can be advantageous if the above-mentioned shield 5 is arranged tightly against (without a gap) the light exit surface 7 of the auxiliary optics 3. In this case, tight (without a gap) means that there is no air gap/distance between the light exit surface 7 of the auxiliary optics 3 and the shield 5. The shield 5 can be made in a single piece, for example with the auxiliary optics 3, or it can be fastened to the auxiliary optics 3 with the help of fastening means, for example screws, nails, or adhesives. If the light module 1 is a low beam light module 1, an advantage is that the shield can, among other things, form a light/dark boundary. It is also conceivable for the shield to be separate from the light exit surface and to be spaced apart from it. Moreover, it is conceivable that the shield 5 can be movable with the help of actuation means (not shown). An advantage of this is that it allows the shape of an emitting surface produced at the light exit surface 7 to be changed quickly, e.g., while the light module in a motor vehicle headlight is in operation. The actuation means can be, for example, in the form of an actuator that moves the shield 5 out of the beam path, causing all the light coming out of the light exit surface 7 of the auxiliary optics 3 to strike the lens 6. This makes it possible, for example, to switch between high beams and low beams. The light exit surface 7 of the auxiliary optics 3 and/or the shield 5 are/is preferably arranged in a focal surface 8 of the lens 6 (e.g., a freeform lens) or spaced apart from it, so that the emitting surface that is produced at the light exit surface 7 and that is put into a predetermined shape by means of the shield 5 is imaged, by this lens 6, in the form of a light pattern in front of the light module 1. Here it should be noted that the focal surface 8 is often also called a projection plane or an intermediate image plane, especially in connection with freeform lenses. The projection plane is that illuminated surface that the imaging freeform lens "throws"/images into the image space, or traffic space, as it is called in connection with the motor vehicle industry. The auxiliary optics 3 can, for example, produce an image of the light source 2, for example light-emitting LED surfaces, in the projection plane, and this image can be imaged, for example onto the road, with a freeform lens. It goes without saying that if the light module is installed in a motor vehicle, the light pattern is produced in front of the motor vehicle and can correspond to a light distribution, preferably one that is legally compliant. The only parts of the light module/motor vehicle lighting device that are schematically shown are those that can play a role in the embodiments shown. Of course a light module that is fit for use can also have other parts, such as, for example, heat sinks, supporting frames, mechanical and/or electrical control devices, covers, and so on and so forth. However, for simplicity, these standard components of a motor vehicle lighting device/light module will not be described here.

Figure 3:
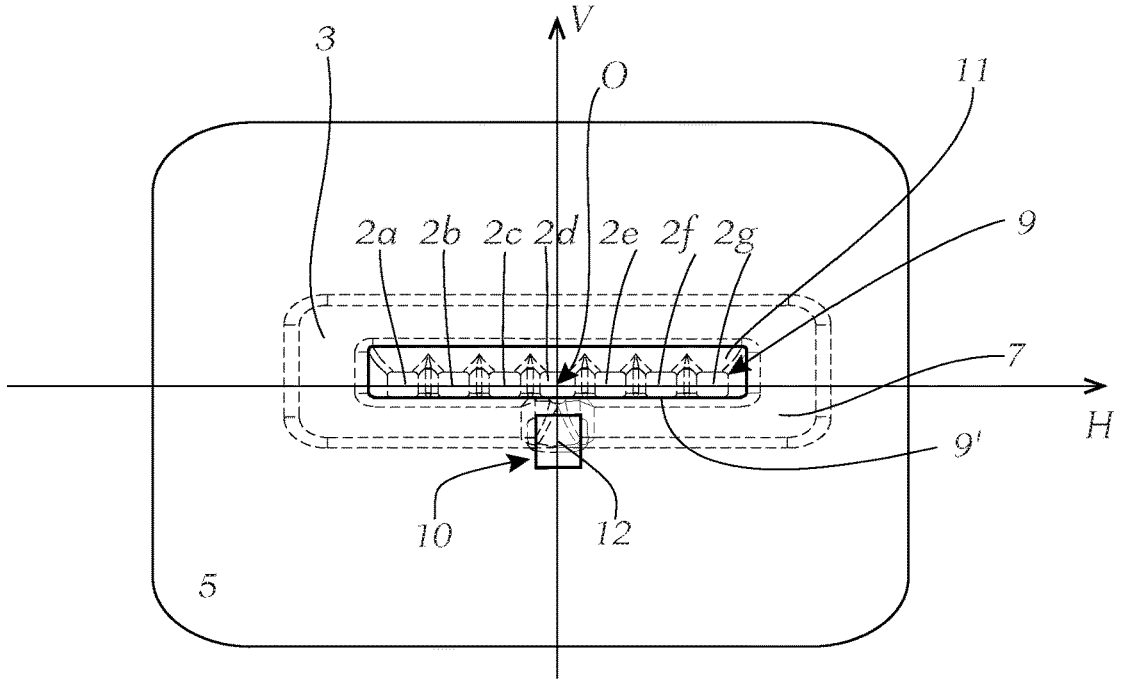
FIG. 3 is a front view of a shield and auxiliary optics.

FIG. 3 shows a front view of the shield 5, behind which there are auxiliary optics 3 in front of the light source 2. The light source 2 is in the form of a row of seven LEDs 2*a* through 2*g* that are arranged next to one another, this row being, for example, horizontally oriented. The terms "horizontal" and "vertical", "down" and "up" refer to the light module 1 that has been installed in a motor vehicle. The number of LEDs is, of course, irrelevant: more than seven or fewer than seven LEDs can also be used. It is also conceivable for the LEDs to be arranged not in a row, but rather, e.g., in a matrix. The shield 5 has two openings 9, 10. These two openings produce an emitting surface that is formed from two non-overlapping areas 11, 12. A first light beam emerges from a first area 11 that is formed with the help of a first opening 9, and this first light beam forms a main light distribution, for example a foreground light distribution 31, in the light pattern. A second light beam emerges from a second area 12 that is formed with the help of a second opening 10, and this second light beam forms the sign light partial light distribution 32 in the light pattern. In the context of this invention, a foreground light distribution 31 is understood to be an illumination of the road below the horizon up to shortly (2-5 m) in front of the vehicle. It is a dimmed light distribution with a usually straight horizontal light/dark boundary 33 (see e.g., FIG. 10). However, it can also be a classic low beam pattern with an asymmetric rise. The shape of the light/dark boundary can be determined, for example, by a corresponding design of a lower edge 9' of the first opening 9.

Figure 9:
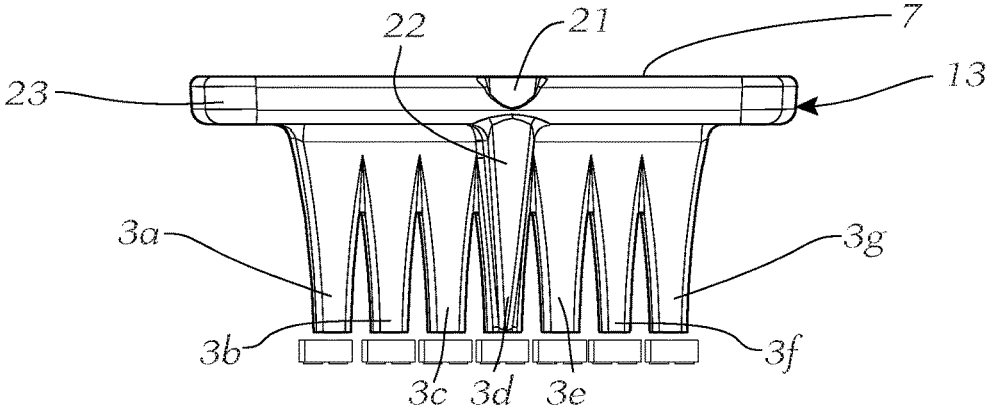
FIG. 9 is a bottom view of FIG. 8.
Figure 10:
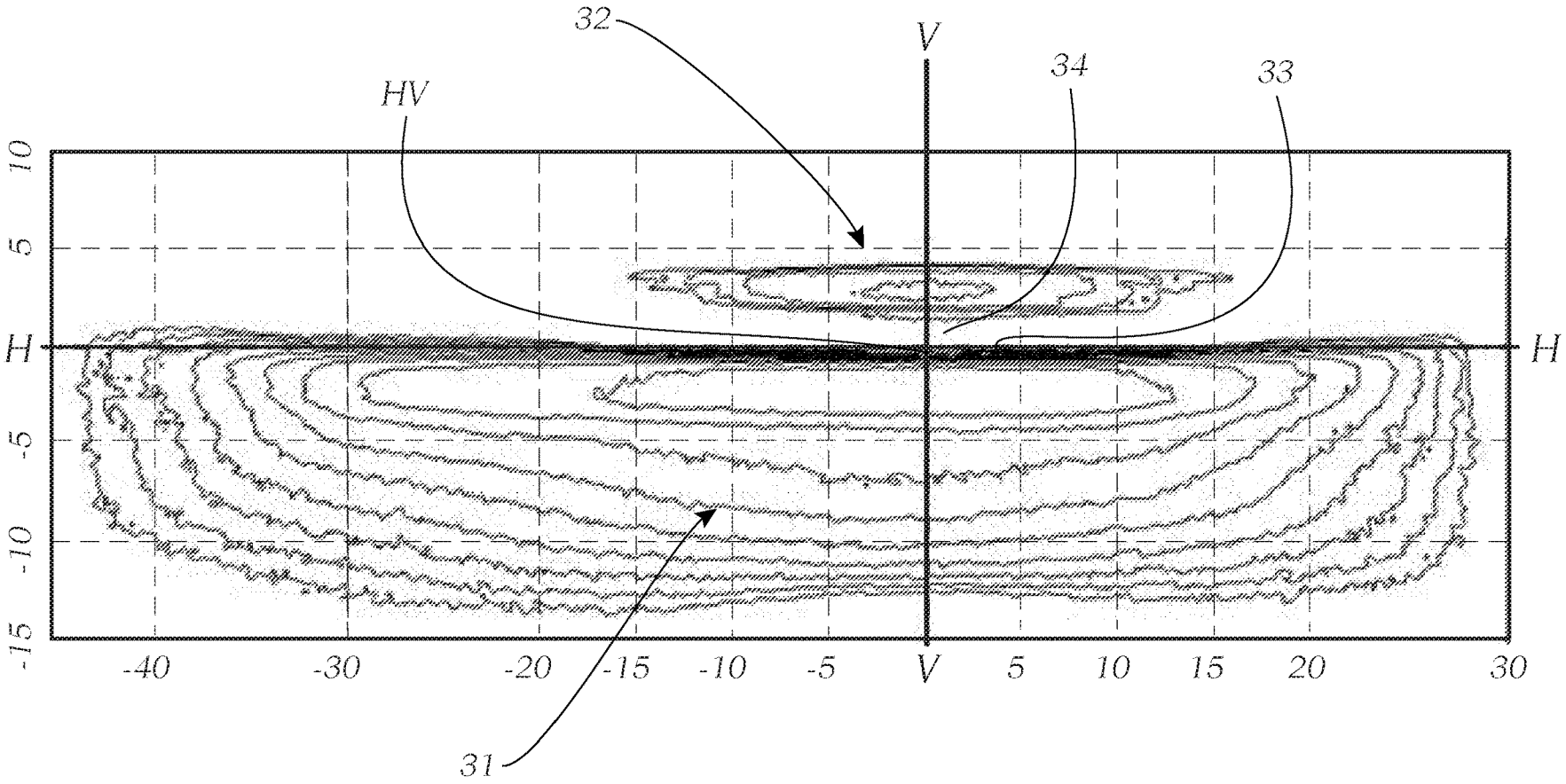
FIG. 10 is a foreground light distribution with a straight light/dark boundary and a sign light partial light distribution.

A straight horizontal lower edge 9' of the first opening 9 can produce a straight light/dark boundary. If the lower edge 9' of the first opening 9 has a sharp bend/Z-shaped rise in the middle, then the classic rise, that is the sharp bend/Z-shaped rise, of a light/dark boundary is produced. The openings 9, 10 shown in FIG. 3 are rectangular. However, it is conceivable for the openings 9, 10 to have another shape different from that of a rectangle. The corners of the openings 9, 10, or the 9, 10 themselves, can be rounded, for example. It is advantageous for the first opening 9, as is shown in FIG. 3, to have an oblong shape extending in the horizontal direction H. An advantage of this oblong shape of the first opening 9 is that it extends the main light distribution that is produced and makes it possible, for example, to meet the legal requirements on a foreground light distribution (e.g., illumination in an area horizontally extending between −40° and +40°). The extension of the second opening 10 can be substantially less, so that its maximum value is a fraction (for example, a seventh) of the maximum extension of the first opening 9. As has already been described, the second luminous area 12 of the light exit surface 7, this second luminous area 12 being limited by the second opening 10, is set up to form the sign light partial light distribution. In order that the first light beam and the second light beam be spatially separated, it can be useful for the second opening 10 to be spaced apart from the first opening 9, as is shown in FIGS. 1 and 3. The distance between the openings 9, 10 depends essentially on the legal requirements on the sign light partial light distribution and the optical parameters (for example, the focal length) of the optical imaging system (for example, the lens 6). The second opening 10 can be arranged beneath and about in the center of the oblongly extending first opening 9. This is especially favorable if the auxiliary optics 3 and the first opening 9 are designed to be symmetrical with respect to a downward projecting V, mentioned above. It can be generally useful for the second opening 10 to be symmetrically arranged with respect to the vertical line V. Here it goes without saying that a person skilled in the art will accordingly adjust the optically relevant components, for example the optical device, the optical imaging system, and the shield. For example, it is useful to position the auxiliary optics 3, the shield 5, and the lens 6 so that a coordinate system HOV (see FIG. 3) associated with the motor vehicle lighting device corresponds to a coordinate system H'V' on a plotting screen in an illuminating engineering laboratory, i.e., for example, so that the origin O of the coordinate system HOV corresponds to the HV point (see, e.g., FIG. 10). This makes it possible, for example, to achieve correct positioning of the sign light partial light distribution without further effort—the sign light partial light distribution is symmetric with respect to the vertical line V' on the plotting screen, as can be seen in FIG. 10, for example. The luminous areas 11, 12 can emit different luminous flux. Since the sign light partial light distribution represents substantially "weaker" illumination, it can even be advantageous, if the second area 12 emits a smaller luminous flux than the first area 11. Here it should be noted that according to ECE R123 a sign light partial light distribution measured on a plotting screen at a 25 m distance may not exceed a value of 625 candelas. Therefore it can be advantageous if only part of the light source 2, for example one LED 2*d*, contributes to the illumination of the second area 12, rather than the entire light source 2. To accomplish this, it can be useful to create special auxiliary optics, which will be described in detail below with reference to FIGS. 4 through 9.

Figure 4:
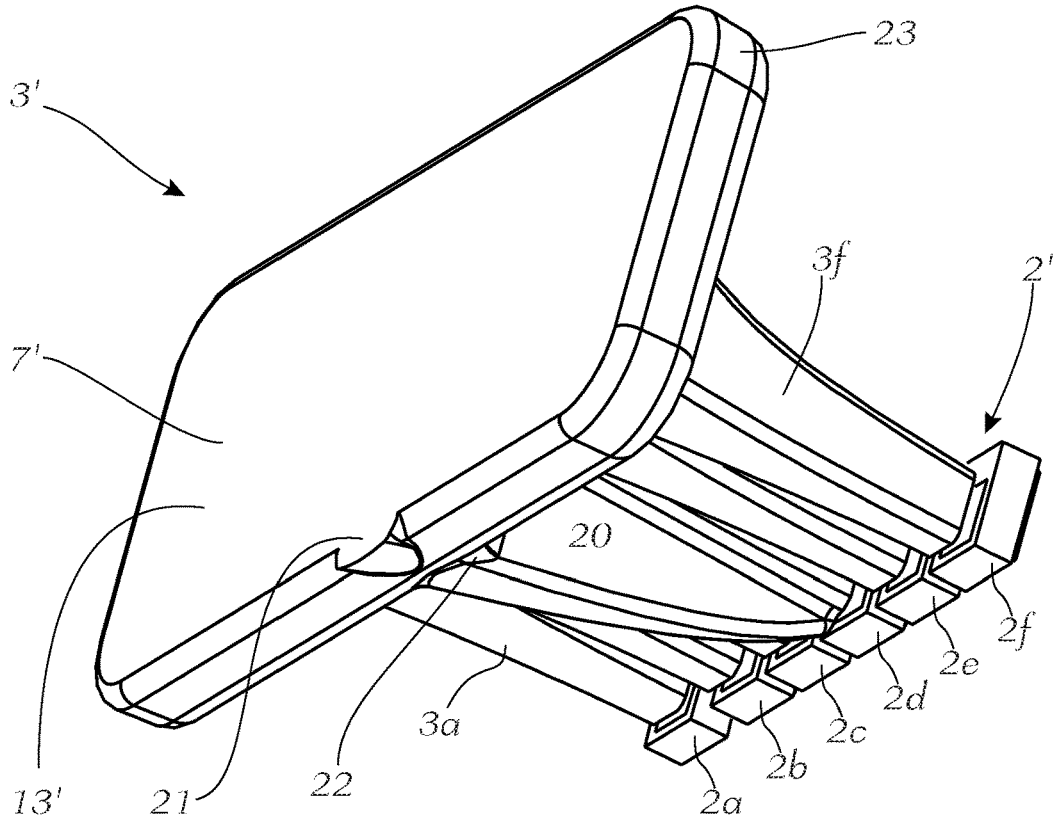
FIG. 4 is a perspective view of auxiliary optics in front of light sources.
Figure 8:
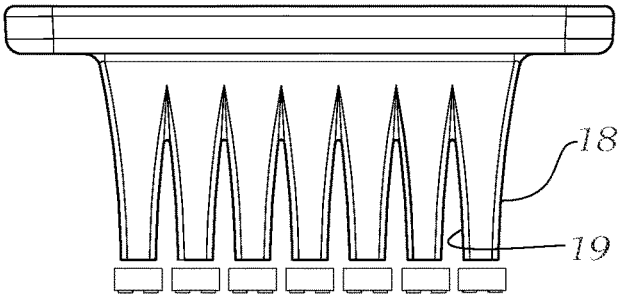
FIG. 8 is a top view of auxiliary optics in front of light sources.

FIG. 4 shows a perspective view of auxiliary optics 3' in front of a light source 2'. The light source 2' now has, for example, six LEDs 2*a* through 2*f*. The auxiliary optics 3' have a continuous light exit surface 7', and in this respect are the same as the auxiliary optics 3 of FIGS. 1 through 3 and FIGS. 5 through 9. The auxiliary optics 3, 3' shown have a different number of arms. The arms are in the form of light-conducting optical bodies. However, it can be expedient if this number corresponds to the number of LEDs, for example. The arms 3*a* through 3*g* of the auxiliary optics 3 of FIGS. 1 through 3 and FIGS. 5 through 9 and the arms 3*a* through 3*f* of the auxiliary optics 3' of FIG. 4 come from a plate (light exit plate) 13, 13' and taper toward where they end in front of the light source 2, so that there is an air gap 14 between arm ends 15 and the light source 2. All arms 3*a* through 3*c* and 3*e* through 3*f* or 3*g* can be the same, except for one arm 3*d*. However, it is conceivable that the arms 3*a* through 3*c* and 3*e* through 3*f* or 3*g* can be different. Moreover, the arms of arm pairs that are symmetrically arranged with respect to the arm 3*d* on both sides of it, e.g., the arm 3*c* and the arm 3*e* or the arm 3*b* and the arm 3*f*, can be the same. The arms have an upper surface 16 with a concave curvature, and a lower surface 17 that is essentially straight, and lateral surfaces 18, 19 with a concave curvature. These surfaces 16 through 19 of the arms 3*a* through 3*c* and 3*e* through 3*f* or 3*g* can have a different curvature, for example they can be curved to a different extent. Between the surfaces there is an optical medium. The shape of the surfaces 16 through 19 that delimit the medium is adapted to the refractive index of the medium so that light beams propagating within the arms 3*a* through 3*g*/3*f* do not leave the arms due to total reflection, and essentially can only come out of the auxiliary optics 3, 3' through the light exit surfaces 7, 7'. As can be seen in FIGS. 8 and 9, which show a top view and a bottom view of the auxiliary optics 3, the arms 3*a* through 3*g* come together at a distance in front of the plate 13, so that light beams coming out of different arms mix/overlap as they propagate in the direction toward plate 13, and then, in their further course, as they propagate in the direction toward light exit surface 7 within plate 13. This means that what is imaged into the focal surface or projection plane 8 of the lens 6 is not individual light emission surfaces of the LEDs, but rather a homogeneously luminous light exit surface 7, on which the individual LED images are not perceptible. An advantage of this is that the light distribution that is produced is also homogeneous.

Figure 5:
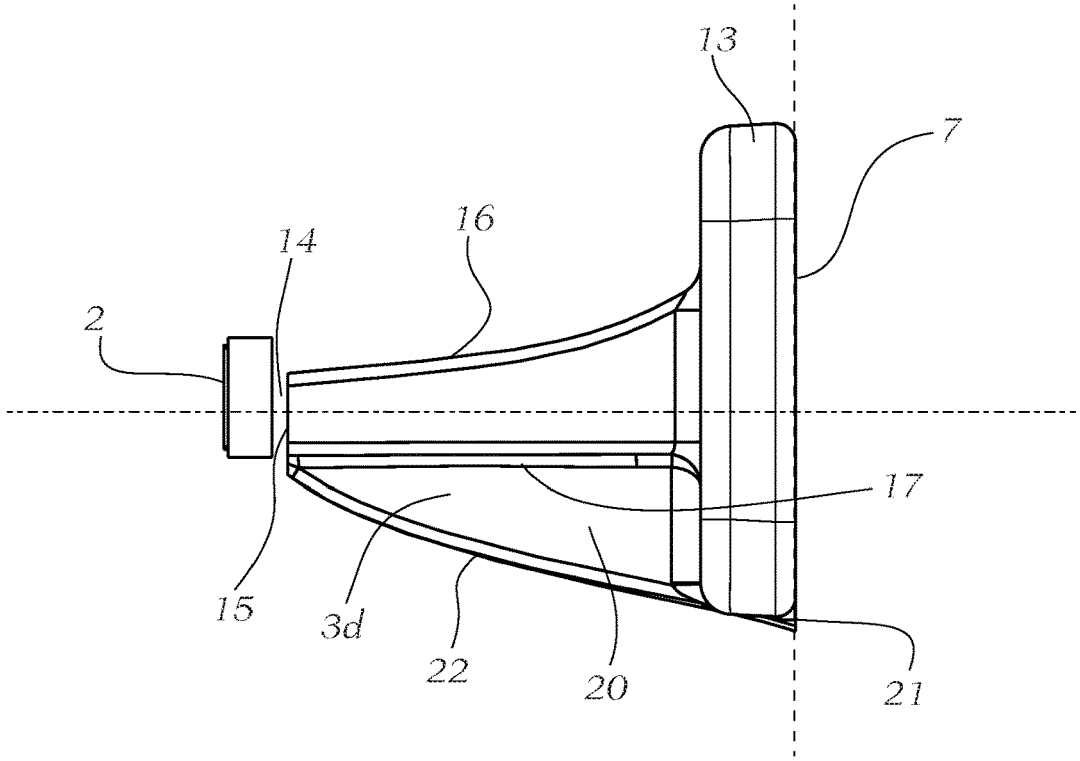
FIG. 5 is a side view of FIG. 4.
Figure 6:
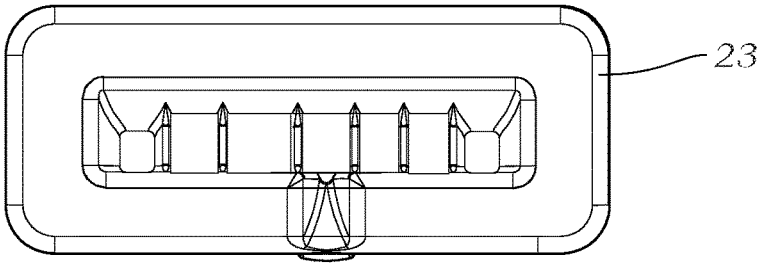
FIG. 6 is a rear view of the auxiliary optics.
Figure 7:
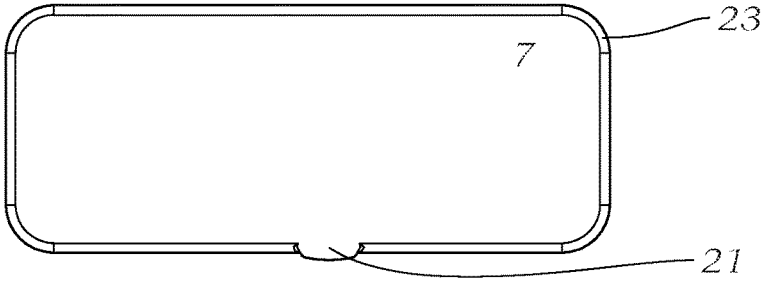
FIG. 7 is a front view of the auxiliary optics of FIG. 6.

As is mentioned above, the auxiliary optics 3, 3' have one arm 3*d* that is different from the rest of the arms. If the arms of the auxiliary optics are arranged in a row, this arm 3*d* preferably lies about in the center of this row (see, e.g., FIG. 4). As can be seen in FIG. 5, the one arm 3*d* has a downward-projecting, preferably convex lower area 20 that extends from a light entrance surface 15 of the arm 3*d* to the light exit surface 7 and becomes steadily taller in this direction. For example, the lower area 20 can be about 2 mm tall and 2 mm long, and have a cross-sectional width of about 20 mm. The arm 3*d* is generally shaped so that at least part of the light that is coupled into this arm 3*d* from the LED 2*d* that is associated with this arm 3*d* can be used to form the second light beam. The lower area 20 of the arm 3*d* discharges into a bulging area 21 of the light exit surface 7, this bulging area 21 projecting beyond an edge 23 of the light exit surface 7 (FIGS. 4 through 7 and 9). It can be advantageous if the second opening 10 of the shield 4 is arranged to fit the bulging area 21 and is in the form shown in FIG. 1. Light coming out through the bulging area 21 of the light exit surface 7 advantageously has a lower intensity than, for example, light coming from other arms, and this light is used to produce the sign light partial light distribution. Moreover, it can be expedient if a lower limiting side 22 of the lower area 20 is in the form of a part of a paraboloid. In this case, light beams that are coupled into the arm 3*d* and that pass through a focal point of the paraboloid are collimated. This increases, for example, the homogeneity of the sign light partial light distribution.

FIG. 10 shows an example of a light pattern produced with the inventive motor vehicle lighting device. The light pattern comprises a foreground light distribution 31 with a straight light/dark boundary 33 and a sign light partial light distribution 32. The sign light partial light distribution 32 is spaced apart from the foreground light distribution 31, i.e., there is a dark area 34 between these two light distributions in the vertical direction V, as can be seen in FIG. 10. This dark area 34 has the advantage, for example, that the light/dark boundary 33 is not obliterated, but rather remains clearly visible.

Unless it necessarily follows from the description of one of the above-described embodiments, it is assumed that these embodiments can be combined with one another in any way. Among other things, this means that the technical features of one embodiment can also be combined as desired, individually and independently of one another, with the technical features of another embodiment, in order in this way to arrive at another embodiment of the same invention, and to do so without going beyond the original disclosure.

The invention claimed is:

1. A motor vehicle lighting device (1) comprising:

multiple light sources (2*a* through 2*g*);

an optical device (3) comprising multiple light-conducting optical bodies (3*a* through 3*g*) associated with the multiple light sources (2*a* through 2*g*) and into which light of the multiple light sources (2*a* through 2*g*) is irradiated; and an optical imaging system (6) associated with the optical device (3), wherein the optical imaging system is configured to image light exiting from the optical device (3) in front of the motor vehicle lighting device (1), wherein the optical device (3) is configured to concentrate the light of the multiple light sources (2*a* through 2*g*) and to direct it as at least two spatially separated light beams, comprising a first light beam and a second light beam, to the optical imaging system (6), wherein the optical imaging system (6) is configured to project each of the at least two spatially separated light beams in front of the motor vehicle lighting device (1) as a light distribution, and wherein the first light beam is a main light distribution and the second light beam is a sign light partial light distribution, wherein the optical device (3) has at least one shield (5) downstream of it that is arranged perpendicular to an optical axis (4) of the optical imaging system (6), wherein the at least one shield (5) has at least one first opening (9) and at least one second opening (10), wherein the at least one first opening (9) is configured to form the first light beam forming the main light distribution, and wherein the at least one second opening (10) is configured to form the second light beam forming the sign light partial light distribution, and wherein each light-conducting optical body of the multiple light-conducting optical bodies is associated with exactly one light source of the multiple light sources, and wherein each light-conducting optical body is configured so that only the light of the associated light source is coupled into the optical body.

2. The motor vehicle lighting device according to claim 1, wherein the first opening (9) of the shield has a lower edge (9'), the lower edge (9') forming a light/dark boundary in the light pattern, and wherein the second opening (10) is arranged beneath a middle area of the first opening (9).

3. The motor vehicle lighting device according to claim 1, wherein the second opening (10) is arranged beneath the first opening (9) and is symmetrically arranged with respect to a vertical line (V).

4. The motor vehicle lighting device according to claim 1, wherein the shield (5) is arranged in a focal plane (8) of the optical imaging system (6).

5. The motor vehicle lighting device according to claim 1, wherein the optical device (3) has a continuous, light exit surface (7) on which the shield (5) is arranged.

6. The motor vehicle lighting device according to claim 5, wherein the continuous, light exit surface (7) is planar and the shield (5) is arranged thereon without a gap.

7. The motor vehicle lighting device according to claim 1, wherein the multiple light sources (2*a* through 2*g*) are LEDs.

8. The motor vehicle lighting device according to claim 7, wherein the multiple light sources (2*a* through 2*g*) are arranged in a horizontal row perpendicular to the optical axis (4), wherein an optical body (3*d*) of the multiple light-conducting optical bodies lying in a center of the row has a lower area (20) projecting downward, and wherein the lower area (20) extends from a light entrance surface of the optical body (3*d*) lying in the center of the row to the light exit surface (7).

9. The motor vehicle lighting device according to claim 8, wherein the lower area (20) has a lower, parabolic limiting side (22).

10. The motor vehicle lighting device according to claim 8, wherein the optical body (3*d*) lying in the center of the row is set up to form the second light beam.

11. The motor vehicle lighting device according to claim 8, wherein the optical body (3*d*) lying in the center of the row is set up to exclusively form the second light beam.

12. The motor vehicle lighting device according to claim 8, wherein the optical body (3*d*) lying in a center of the row has a lower area (20) projecting downward with a convex shape.

13. The motor vehicle lighting device according to claim 1, wherein the multiple light sources (2*a* through 2*g*) lie in a surface arranged perpendicular to the optical axis (4), and wherein the multiple light-conducting optical bodies (3*a* through 3*g*) taper in the direction toward the light sources.

14. The motor vehicle lighting device according to claim 13, wherein all of the multiple light sources (2*a* through 2*g*) are LEDs and the surface is a plane.

15. The motor vehicle lighting device according to claim 1, wherein all of the multiple light-conducting optical bodies have a common light exit plate (13).

16. The motor vehicle lighting device according to claim 15, wherein the light exit plate (13) is made in a single piece with the multiple light-conducting optical bodies belonging to the part.

17. The motor vehicle lighting device according to claim 1, wherein the main light distribution is in the form of a foreground light distribution with a straight horizontal light/dark boundary or in the form of a low beam pattern with a light/dark boundary having a rise.

18. The motor vehicle lighting device according to claim 1, wherein the optical imaging system (6) is in the form of a lens that collimates the light beam in the vertical direction and widens it in the horizontal direction.

19. The motor vehicle lighting device according to claim 1, wherein the motor vehicle lighting device is disposed in a motor vehicle.

* * * * *